US006336555B1

(12) United States Patent
Breeden

(10) Patent No.: US 6,336,555 B1
(45) Date of Patent: Jan. 8, 2002

(54) MAGNETIC SCHOOL ORGANIZER

(76) Inventor: Kerri Michelle Therriault Breeden, 4945 W. 128th Pl., Broomfield, CO (US) 80020

( * ) Notice: Subject to any disclaimer, the term of this patent is extended or adjusted under 35 U.S.C. 154(b) by 0 days.

(21) Appl. No.: 09/693,113

(22) Filed: Oct. 20, 2000

Related U.S. Application Data

(60) Provisional application No. 60/160,845, filed on Oct. 21, 1999.

(51) Int. Cl.[7] ..... B65D 85/28

(52) U.S. Cl. ..... 206/371; 206/214; 206/350; 383/39

(58) Field of Search ..... 206/350, 214, 206/223, 373, 371; 190/126; 383/39, 40, 2, 41, 72, 74

(56) References Cited

U.S. PATENT DOCUMENTS 2,320,415 A * 6/1943 Dalloz ..... 383/39
3,967,666 A * 7/1976 Farrar ..... 383/39
4,702,378 A * 10/1987 Finkel et al. ..... 206/581
4,718,524 A * 1/1988 Crumley ..... 190/110
4,826,059 A * 5/1989 Bosch et al. ..... 224/183
4,993,551 A * 2/1991 Lindsay ..... 206/373
5,022,521 A * 6/1991 Kane ..... 206/370
5,024,361 A * 6/1991 Flowers ..... 224/223
D347,115 S * 5/1994 Breedlove ..... D3/30.1
5,370,246 A * 12/1994 Traynor ..... 211/86
D378,024 S * 2/1997 Tucker ..... D3/282
5,934,468 A * 8/1999 Scott ..... 206/418
6,116,419 A * 9/2000 Campagna et al. ..... 206/373

* cited by examiner

*Primary Examiner*—Shian Luong
(74) *Attorney, Agent, or Firm*—Jennifer L. Bales; Macheledt Bales LLP

(57) ABSTRACT

A school organizer capable of magnetically attaching to a desk includes a main back portion, which is formed of a single piece of fabric, which is folded in half and sewn to form a top compartment for magnets, a main compartment for markers and paper, and a bottom compartment for pencils and the like. The fabric piece is folded up vertically and a vertical seam is sewn to form the main compartment. A snap holds the main compartment closed. Then the doubled fabric is folded upward again, toward the front, and two vertical seams are sewn along the sides to form the bottom compartment. Another snap is used to hold the bottom compartment closed. Four seams form a closed top compartment for holding the magnets in place. The organizer further includes a sewn on front pocket portion, which is formed of a single piece of cloth sewn to the front of the main portion. A bottom seam, together with a series of vertical seams, form several pockets between the front portion and the main portion. A scissor holder is formed of a loop of fabric sewn to the front of one of the front pockets.

19 Claims, 6 Drawing Sheets

MAGNETIC SCHOOL ORGANIZER

This application claims the benefit of U.S. Provisional Application No. 60/160,845, filed Oct. 21, 1999.

BACKGROUND OF THE INVENTION

1. Field of the Invention

The present invention relates to a school organizer which magnetically attaches to a desk.

2. Description of the Prior Art

Primary school children need a variety of supplies during the school day. For example, a student might need pencils and pens, a pad of paper, a ruler, glue, scissors, a calculator, and crayons. If these items are placed in the student's desk, they inevitably mix together and form a disorganized mess. In addition, the student is unable efficiently to transport the supplies to another work area.

A need remains in the art for an organizer for school supplies that magnetically attaches to the outside of a desk, and can be removed and carried to another area.

SUMMARY OF THE INVENTION

The present invention is an organizer for school supplies that magnetically attaches to the outside of a desk, and can be removed and carried to another area.

A storage and carrying device for school supplies comprises a cloth carrier having several pockets of various sizes for holding pencils, glue, calculator, crayons, markers, a note pad, etc. The organizer comprises a main back portion formed of a single piece of fabric, which is folded in half and sewn to form a top compartment for magnets, a main compartment for markers and paper, and a bottom compartment for pencils and the like.

The organizer further includes a sewn on front pocket portion, which is formed of a single piece of cloth sewn to the front of the main portion and further having a series of vertical seams which form several pockets of various sizes between the front portion and the back portion.

Finally, the organizer includes a scissor holder, comprising a loop of fabric sewn to the front of one of the front pockets. A snap or velcro closure holds the bottom compartment closed, and a second snap holds the main compartment closed.

DETAILED DESCRIPTION OF THE PREFERRED EMBODIMENT

Figure 1:
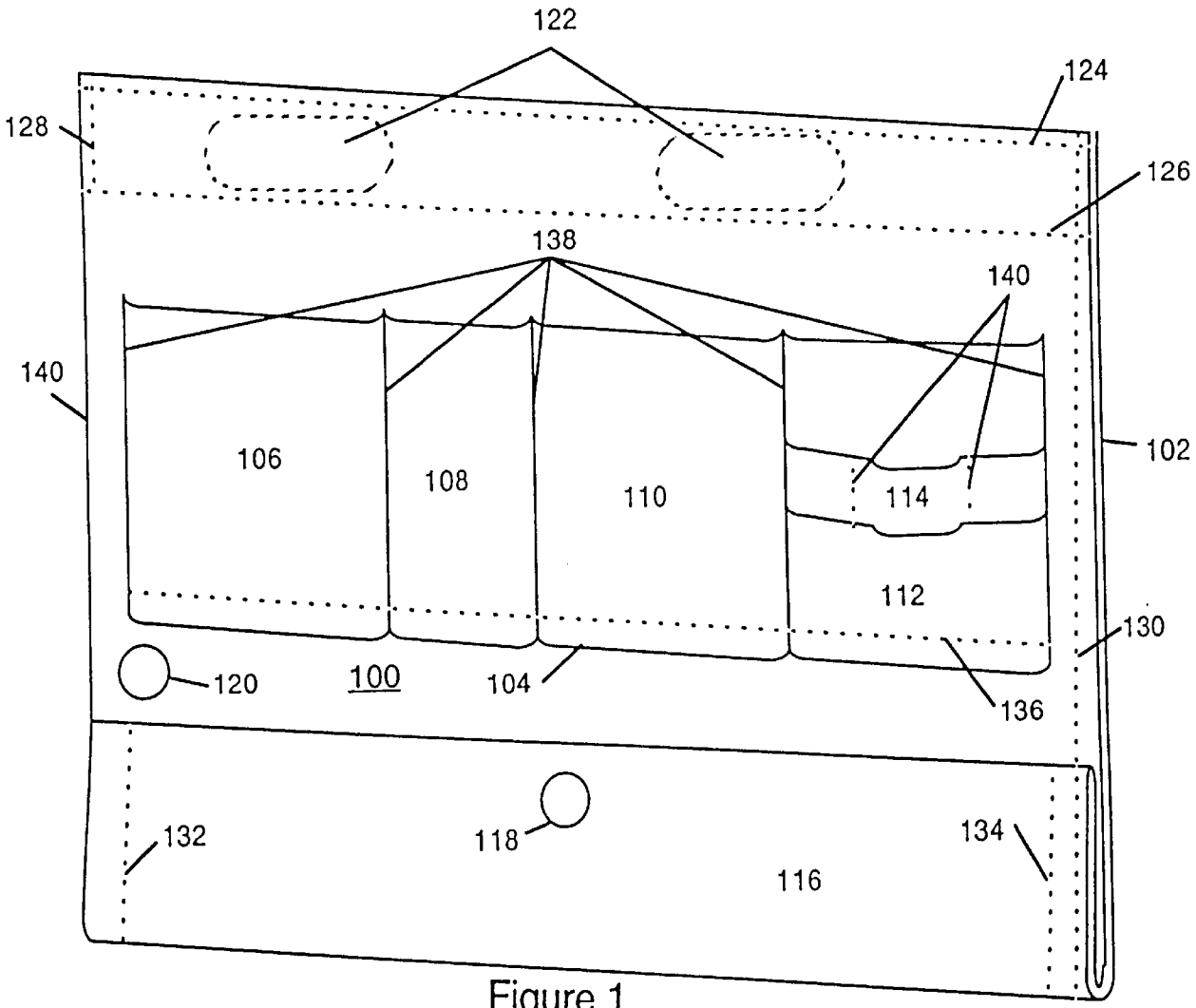
FIG. 1 shows an isometric view of a school organizer according to the present invention, which is capable of magnetically attaching to a desk.

FIG. 1 shows an isometric view of a school organizer 100 according to the present invention, which is capable of magnetically attaching to a desk (not shown). Organizer 100 comprises a main back portion 102, which is formed of a single piece of fabric, which is folded vertically in half and sewn to form a top compartment 123 for magnets 122, a main compartment 140 (better shown in FIG. 5) for markers and paper (not shown), and a bottom compartment 116 for pencils and the like (not shown).

The main fabric piece is folded upward and seam 130 is sewn to begin forming main compartment 140. Snap 120 holds main compartment 140 closed. Then the doubled fabric is folded upward again, toward the front, and seams 132 and 134 are sewn to form bottom compartment 116. Snap 118 is used to hold bottom compartment 116 closed.

Seams 124, 126, 128, and 130 form a closed top compartment 123 for holding magnets 122 in place. Magnets 122 allow organizer 100 to securely attach to a steel desk, cabinet, or the like.

The organizer further includes a sewn on front pocket portion 104, which is formed of a single piece of cloth sewn to the front of back portion 102. Seam 136, together with a series of vertical seams 138, form several pockets 106, 108, 110, and 112 between front portion 104 and back portion 102.

Finally, organizer 100 includes a scissor holder 114, comprising a loop of fabric sewn to the front of one of the front pockets 112, with seams 140 along the side of the loop.

Figure 2:
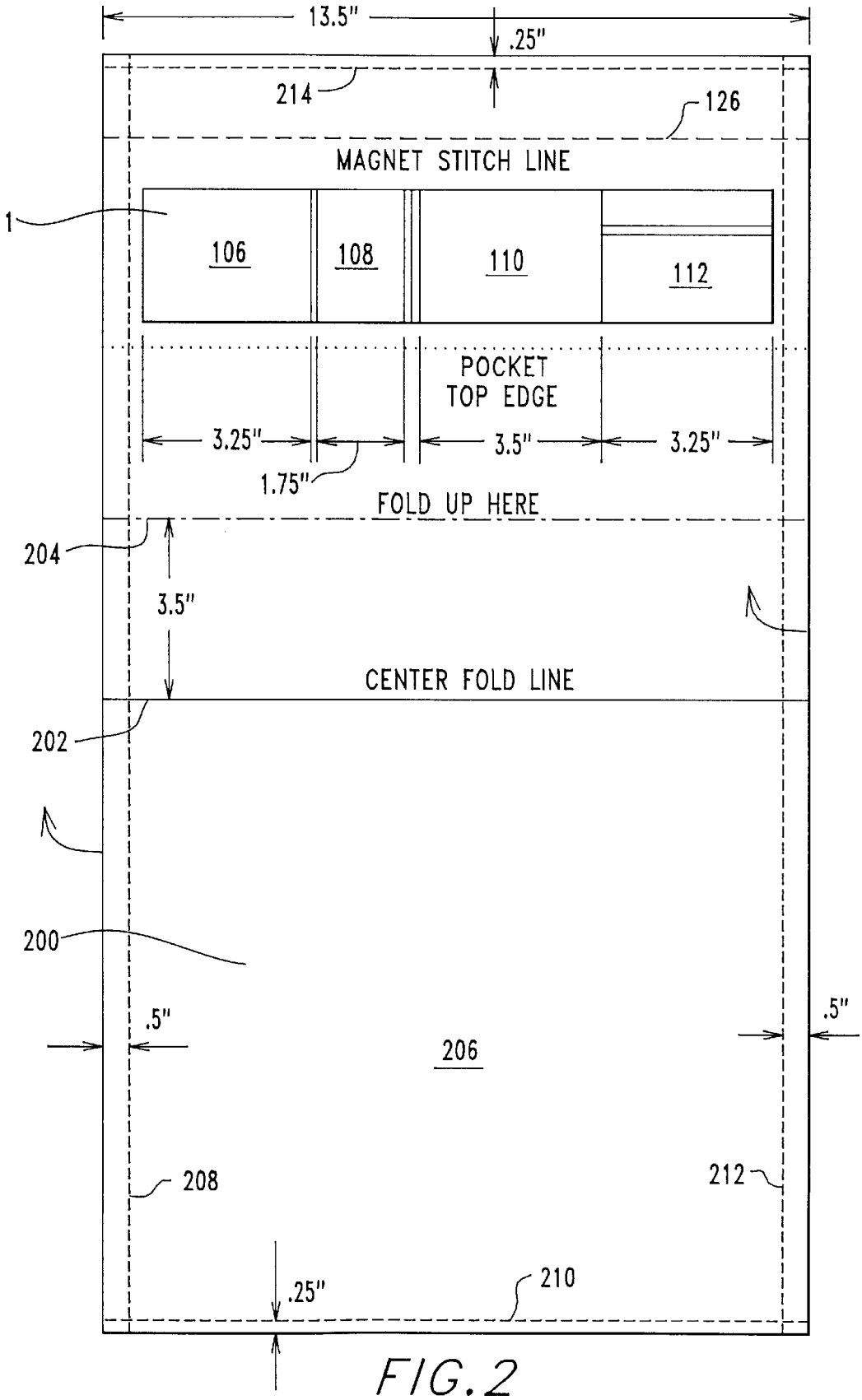
FIG. 2 shows a front view of the single piece of fabric used to make the main back portion of the school organizer of FIG. 1.

FIG. 2 shows a front view of the single piece of fabric 200 used to make the main back portion 102 of school organizer 100. In the preferred embodiment, a single piece of canvas, 26 inches long by 13½ inches wide, comprises fabric piece 200. First, each edge of piece 200 is folded over ½ inch and sewn as seams 208, 210, 212, and 214. Bottom half 206 is folded backward at center fold line 202, and the right edges are sewn together by seam 130 (see FIG. 1). Next, bottom compartment 118 is formed by folding up the fabric at fold line 204 and sewing the two layers of the compartment to the top layer underneath.

This procedure results in a main compartment 140, which has been formed between the front and back layers of main back portion 102. Main compartment 140 has an opening along the left side of main back portion 102. As shown in FIG. 1, a snap 120 may be used to hold main compartment 140 closed. A velcro closure or the like may also be used.

Magnets 122 are sewn into compartment 123 (see FIG. 1) using seams 124, 126, and 128 (seam 130 is already in place). Finally, front pocket portion 104 is sewn on the front of main back portion 102.

Figure 3:
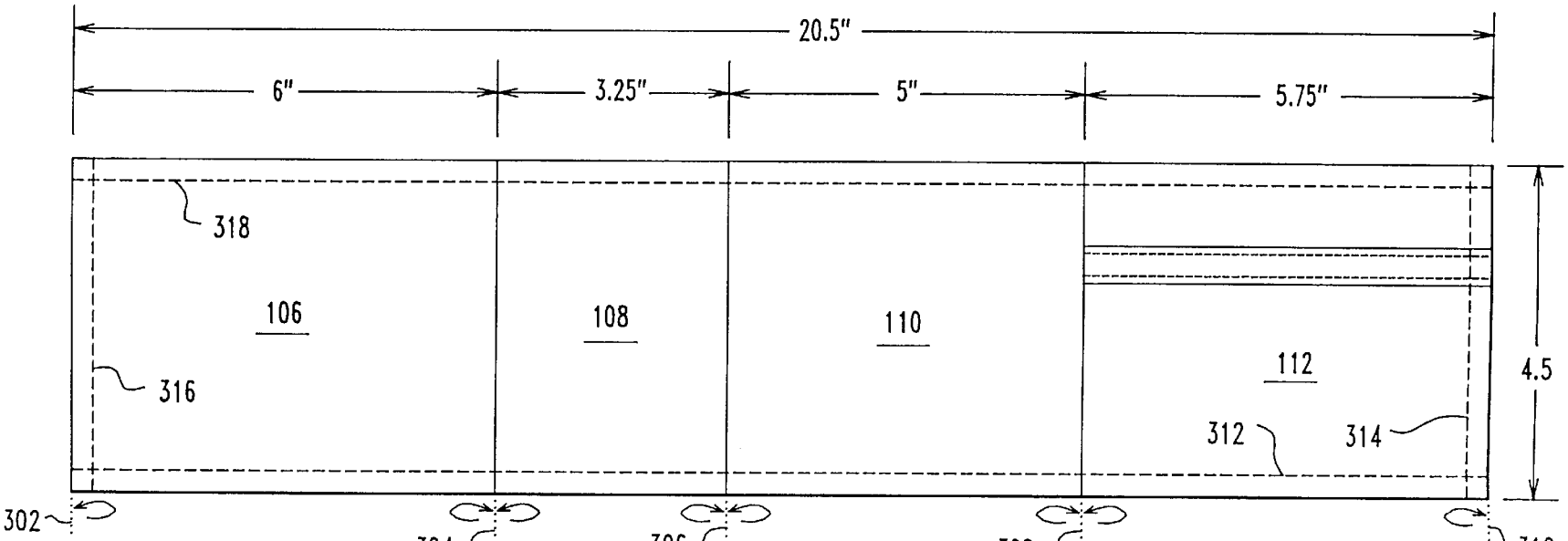
FIG. 3 shows the piece of fabric used to make the front pocket portion of the school organizer of FIG. 1.

FIG. 3 shows the piece of fabric 300 used to make the front pocket portion 104 of school organizer 100. In the preferred embodiment, fabric piece 300 is 20½ inches wide by 4½ inches high. Each edge is folded over and sewn to form seams 312, 314, 316, and 318. Pleats 304, 306, and 308 form pockets 106, 108, 110, and 112, and seams 138 secure the pockets to main back portion 102 (see FIG. 1). In the preferred embodiment, the pockets formed are 4 inches high, and are, from left to right, 3¼ inches wide (for crayons), 1¾ inches wide (for a glue stick), 3½ inches wide (for a calculator), and 3¼ inches wide (for glue).

Figure 4:
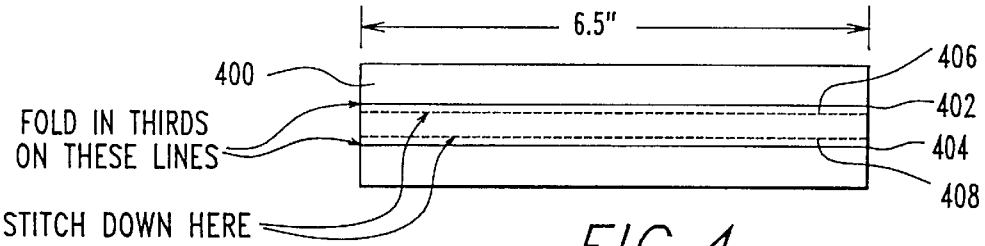
FIG. 4 shows a front view of the piece of fabric used to make the scissor holder of FIG. 1.

FIG. 4 shows a front view of the piece of fabric 400 used to make scissor holder 114, shown in FIG. 1. In the preferred embodiment, piece 400 is ¾ inches high by 6½ inches wide. It is folded into thirds at fold lines 402 and 404, and stitched at seams 406 and 408, to form an elongated strip of reinforced cloth. It is sewn to the front of one of the pockets of pocket portion 104, as shown in FIG. 1. A gap 114 is left to insert the scissors.

Figure 5:
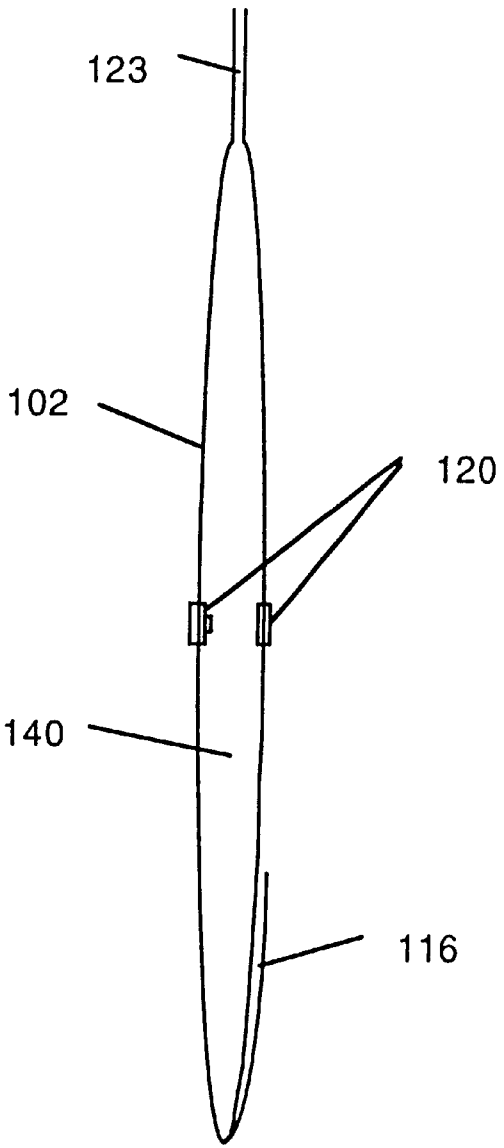
FIG. 5 shows a side view of the organizer of FIG. 1.

FIG. 5 shows a left side view of organizer 100. Some of the features on the front of organizer 100 have been removed for clarity. Main compartment 140 has an opening on the left side of organizer 100, which can be closed with snap 120. This pocket may be used for pads of paper, markers, or the like.

Figure 6:
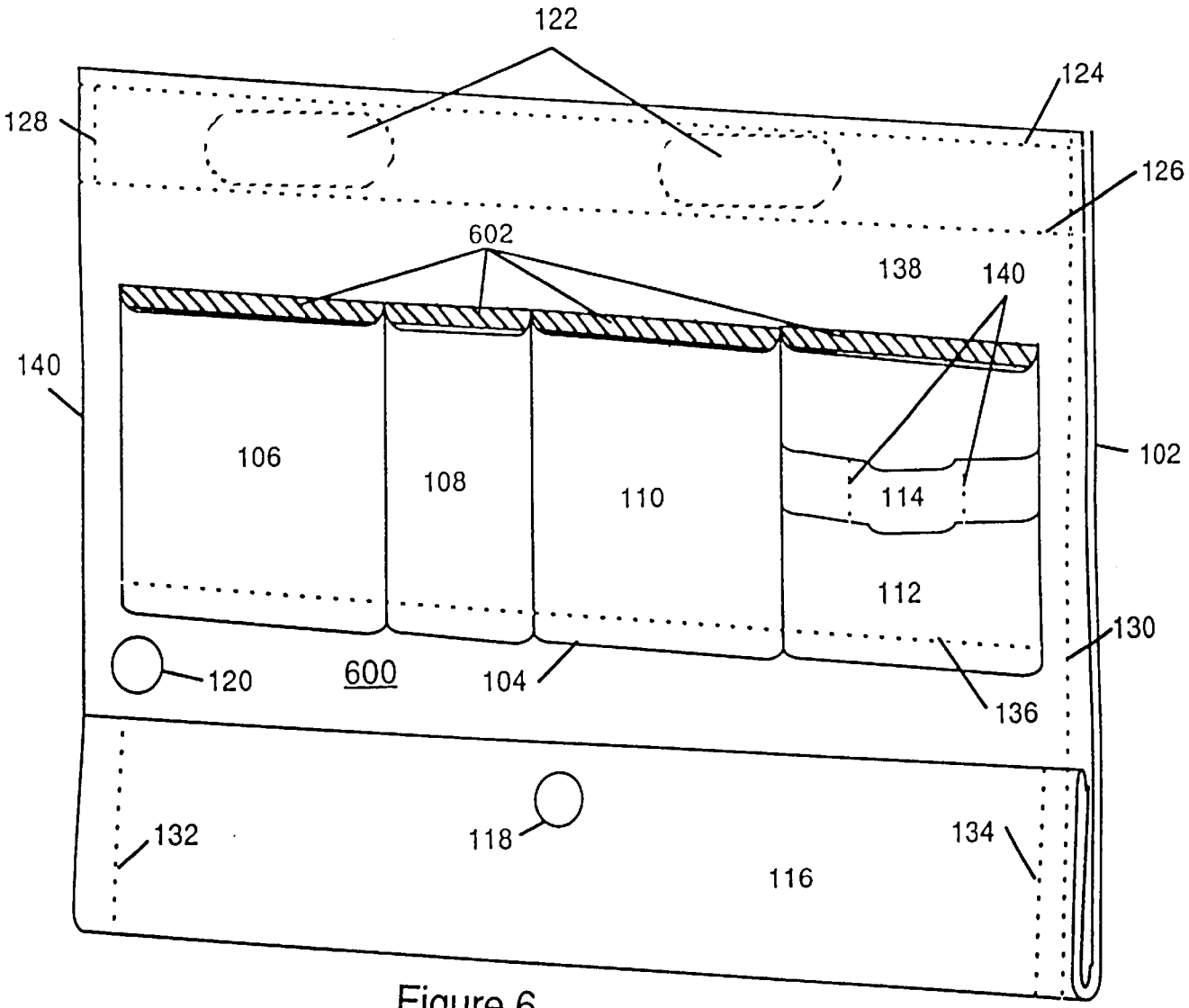
FIG. 6 shows an isometric view of a second embodiment of a school organizer according to the present invention, which is capable of magnetically attaching to a desk.

FIG. 6 shows an isometric view of a second embodiment 600 of a school organizer according to the present invention. It is similar to the embodiment of FIG. 1, except that it further includes elastic straps 602 for securely holding items placed in pockets 106, 108, 110, and 112. Straps 602 are preferably sewn to the front of back portion 102 at each end of each pocket. Two straps 602 may be sewn, one on top of the other, in a single pocket to provide further security, by allowing an item such as a calculator to be secured between the two parallel straps 602. One of the parallel straps may be slightly loose to accommodate the item (e.g. crayons).

Figure 7:
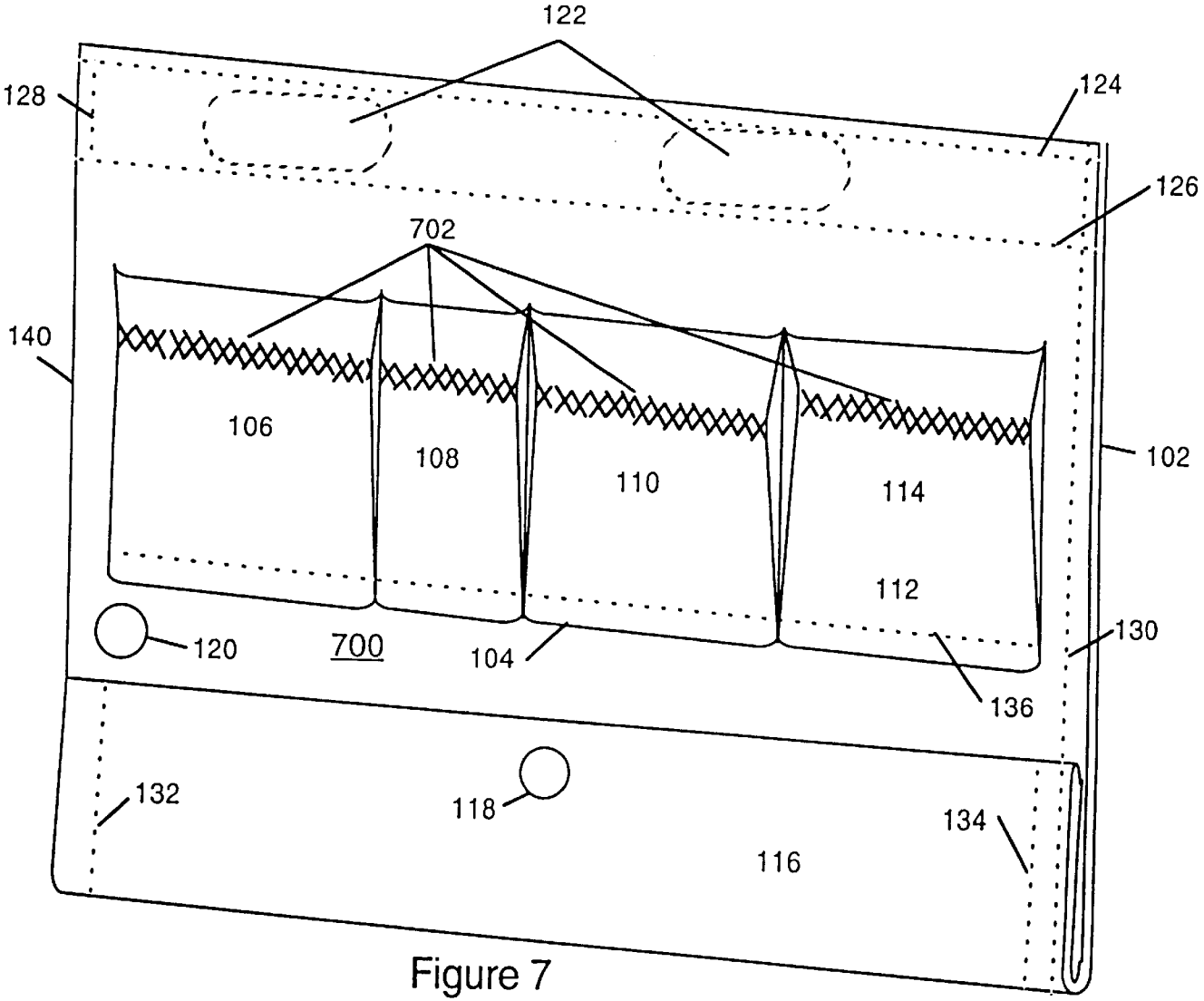
FIG. 7 shows an isometric view of a third embodiment of a school organizer according to the present invention, which is capable of magnetically attaching to a desk.

FIG. 7 shows an isometric view of a third embodiment 700 of a school organizer according to the present invention. It is similar to the embodiment of FIG. 1, except that a strip of elastic 702 is extended and sewn along each pocket 106, 108, 110, and 112. Elastic strip 702 may be sewn along the inside of the pockets or along the outside. As in the embodiment of FIG. 6, the elastic better secures items in the pockets. In the preferred embodiment, elastic strip 702 is about one half the length of front pocket portion 104, so that it grips firmly.

While the exemplary preferred embodiments of the present invention have been described in detail, those skilled in the art will recognize various changes, modifications, additions, and applications other than those specifically mentioned herein which fall within the spirit of this invention.

What is claimed is:

1. An organizer for school supplies that magnetically attaches to the outside of a desk comprising:

a main portion formed of a piece of fabric, the main portion fabric folded in half and sewn along at least two of the three open sides to form a back compartment;

the main portion fabric further folded upward toward the main portion fabric's front a fraction of the main portion fabric's height and sewn along the sides to form a bottom compartment for pencils and the like;

at least one magnet placed in the back compartment to affix the organizer to magnet-attracting items; and a further horizontal seam through the main portion above the bottom compartment, forming a magnet compartment for locating the magnet along the top of the organizer.

at least one vertical seam binding the front portion and the main portion for forming pockets between the front portion and the main portion.

2. The organizer of claim 1, wherein the area under the magnet compartment includes an open side and is adapted for use as a main storage compartment.

3. The organizer of claim 2, further comprising:

a front pocket portion formed of a piece of cloth sewn to the front of the main portion along front pocket portion's sides and bottom; and at least one vertical seam binding the front portion and the main portion for forming pockets between the front portion and the main portion.

4. The organizer of claim 3, further comprising:

a scissor holder, comprising a loop of fabric sewn to the front of the front portion.

5. The organizer of claim 3, wherein the front portion comprises a single piece of cloth.

6. The organizer of claim 2, further comprising:

a closure for holding the bottom compartment closed.

7. The organizer of claim 2, further comprising:

a closure for holding the main compartment closed.

8. The organizer of claim 1 wherein the the main portion comprises a single piece of cloth.

9. An organizer for school supplies that magnetically attaches to the outside of a desk comprising:

a main portion formed of a piece of fabric, the main portion fabric folded in half and sewn along at least two of the three open sides to form a back compartment;

the main portion fabric further folded upward toward the main portion fabric's front a fraction of the main portion fabric's height and sewn along the sides to form a bottom compartment for pencils and the like;

a further horizontal seam through the main portion above the bottom compartment, forming a magnet compartment along the top of the organizer;

wherein the portion of the back compartment under the magnet compartment includes an open side and is adapted for use as a main storage compartment;

a front pocket portion formed of a piece of cloth sewn to the front of the main portion along front pocket portion's sides and bottom;

at least one vertical seam binding the front portion and the main portion for forming pockets between the front portion and the main portion; and at least one magnet placed in the magnet compartment to affix the organizer to magnet-attracting items.

10. The organizer of claim 9, wherein the main portion is formed of a single piece of fabric.

11. The organizer of claim 9, wherein the front portion is formed of a single piece of fabric.

12. The organizer of claim 9, further comprising:

a scissor holder, comprising a loop of fabric sewn to the front of the front portion.

13. The organizer of claim 9, further comprising:

a closure for holding the bottom compartment closed.

14. The organizer of claim 9, further comprising:

a closure for holding the main compartment closed.

15. An organizer for school supplies that magnetically attaches to the outside of a desk comprising:

a main portion formed of a single piece of fabric, the main portion fabric folded in half and sewn along at least two of the three open sides to form a back compartment;

the main portion fabric further folded upward toward the main portion fabric's front a fraction of the main portion fabric's height and sewn along the sides to form a bottom compartment for pencils and the like;

a further horizontal seam through the main portion above the bottom compartment, forming a magnet compartment along the top of the organizer;

wherein the portion of the back compartment under the magnet compartment includes an open side and is adapted for use as a main storage compartment;

a front pocket portion formed of a single piece of cloth sewn to the front of the main portion along front pocket portion's sides and bottom;

at least one vertical seam binding the front portion and the main portion for forming pockets between the front portion and the main portion; and at least one magnet placed in the magnet compartment to affix the organizer to magnet-attracting items.

16. The organizer of claim 15, further comprising:

a scissor holder, comprising a loop of fabric sewn to the front of the front portion.

17. The organizer of claim 15, further comprising:

a closure for holding the bottom compartment closed.

18. The organizer of claim 17, further comprising:

a closure for holding the main compartment closed.

19. The organizer of claim 18, wherein the closures comprise snaps.

* * * * *